US006443760B2

(12) United States Patent
Hasegawa

(10) Patent No.: US 6,443,760 B2
(45) Date of Patent: Sep. 3, 2002

(54) CONNECTOR

(75) Inventor: Teruaki Hasegawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/820,344

(22) Filed: Mar. 29, 2001

(30) Foreign Application Priority Data

Apr. 6, 2000 (JP) ..... 2000-104618

(51) Int. Cl.[7] ..... H01R 3/00
(52) U.S. Cl. ..... 439/489; 439/352; 439/353
(58) Field of Search ..... 439/489, 372, 439/352, 310, 488, 923, 159, 188, 353

(56) References Cited

U.S. PATENT DOCUMENTS 5,839,915 A * 11/1998 Ford et al. ..... 439/489
6,024,595 A * 2/2000 Saba et al. ..... 439/489
6,109,955 A 8/2000 Hanazaki et al.

* cited by examiner

*Primary Examiner*—Tho D. Ta
*Assistant Examiner*—Phuong Nguyen

(74) *Attorney, Agent, or Firm*—Banner & Witcoff, Ltd.

(57) ABSTRACT

The invention avoids the problem of resilient stopping arms losing their resilience. A female housing has a locking arm capable of engaging with a locking member of a male housing protruding therefrom. A detecting member is attached to a posterior side of this female housing. A pair of resilient stopping legs extend in an anterior direction from a main body of the detecting member. Anterior end portions of the resilient stopping legs have outwardly protruding hook-shaped protrusions protruding therefrom, these engaging with temporary stopping holes or main stopping holes provided in side walls of the female housing. Retaining protrusions protrude further outwards from protruding anterior ends of the resilient stopping legs. These retaining protrusions protrude to the exterior of the female housing from the temporary stopping holes or the main stopping holes. Recessed grooves corresponding in location to the main stopping holes are formed in inner side faces of a hood of the male housing. The retaining protrusions that protrude from the main stopping holes are inserted into these recessed grooves in the hood. When the detecting member is in an operating position and the resilient stopping legs are in an inserted state within the main stopping holes, these resilient stopping legs return to their original free state.

11 Claims, 6 Drawing Sheets

CONNECTOR

TECHNICAL FIELD

The present invention relates to an electrical connector, particularly a connector provided with a fitting detecting function.

BACKGROUND TO THE INVENTION

One example of a connector provided with a fitting detecting member for checking the fitting state of male and female connector housings is desribed in JP 11-26089. This connector has a locking arm provided on an upper face of a female housing that fits within a hood of a male connector, this locking arm engaging with a locking member provided in the male connector. A pair of protecting walls protrude from left and right sides of the locking arm, and a detecting member is attached to the posterior of the locking arm. The detecting member can be inserted from a waiting position at the exterior of the locking arm to an operating position within a bending space of the locking arm. While the locking arm is in a bent state while the two housings are being fitted together, the detecting member makes contact with the locking arm, thereby preventing further movement of the detecting member towards the operating position. That is, the fitting state of the two housings can be detected according to whether the detecting member moves or not.

A pair of detecting arms extend towards the anterior from the detecting member. The anterior ends of these resilient stopping arms engage with a posterior end face of the protecting wall, thereby preventing the detecting member from moving from the waiting position towards the anterior. Outwardly extending protrusions (extending to the exterior of the protecting wall) are provided on side faces of the resilient stopping arm. Inner faces of the hood of the male housing engage with the outwardly extending protrusions while the two housings are being fitted together, thereby bending the detecting arms inwards and releasing them from their retained state with the protecting wall. This allows the detecting member to be pushed in towards the operating position. After the detecting member has been pushed in to the operating position, the detecting arms are maintained in a bent state whereby the outwardly extending protrusions make contact with the inner faces of the hood, the resilient force of the detecting arms preventing the detecting member from leaving the operating position.

While the connector is being used after the fitting operation has taken place, the resilient stopping arm remains in a bent state. If the resilient stopping arm remains in this state for a long period, the creep phenomenon may affect the resilience thereof, and the resilient stopping arm may lose its resilience.

Consequently, after the connector has temporarily been separated for maintenance or the like, it is possible that the detecting member cannot be maintained in the waiting position or the operating position when the two housings are again fitted together. The present invention has taken the above problem into consideration, and aims to present a connector wherein a resilient stopping arm does not lose its resilience.

SUMMARY OF THE INVENTION

According to the invention there is provided a connector comprising a first housing having a hood and a second housing insertable within said hood in a fitting direction to a fully inserted condition, the second housing having a bendable latching arm extending in the fitting direction and engageable with a latch member of said first housing in the fully inserted condition, and the connector further including a detecting member movable from a waiting position to an advanced condition in which said detecting member enters a bending space of said latching arm to prevent bending movement thereof, wherein said second housing has upstanding side walls extending in the fitting direction on either side of said latching arm and at a distance therefrom, said detecting member having two resilient legs extending respectively between said latching arm and a corresponding side wall, each leg having an outwardly extending protrusion engageable through a corresponding aperture of a said respective side wall and for maintaining said detecting member in the waiting position, said hood being adapted to engage said protrusions on insertion of said second housing, and to force said protrusions inwards through the respective aperture to a releasing condition, and said side walls having respective openings to receive said protrusions in the advanced condition of said detecting member, thereby to retain said detecting member in said bending space, the first housing having recesses within said hood to accommodate said protusions in the fully inserted condition of said second housing thereby permitting said legs to be unbent in the advanced condition of the detecting member.

Such an arrangement ensures that the resilient legs of the detecting member do not lose resilience during the period of connection of the housings.

Preferably the recesses of the hood comprises channels open to the rear side, thus permitting moulding of the first housing without the use of removable inserts.

Preferably associated contact surfaces of the protrusion, first housing and second housing are chamfered or tapered sufficiently to ensure good operability.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
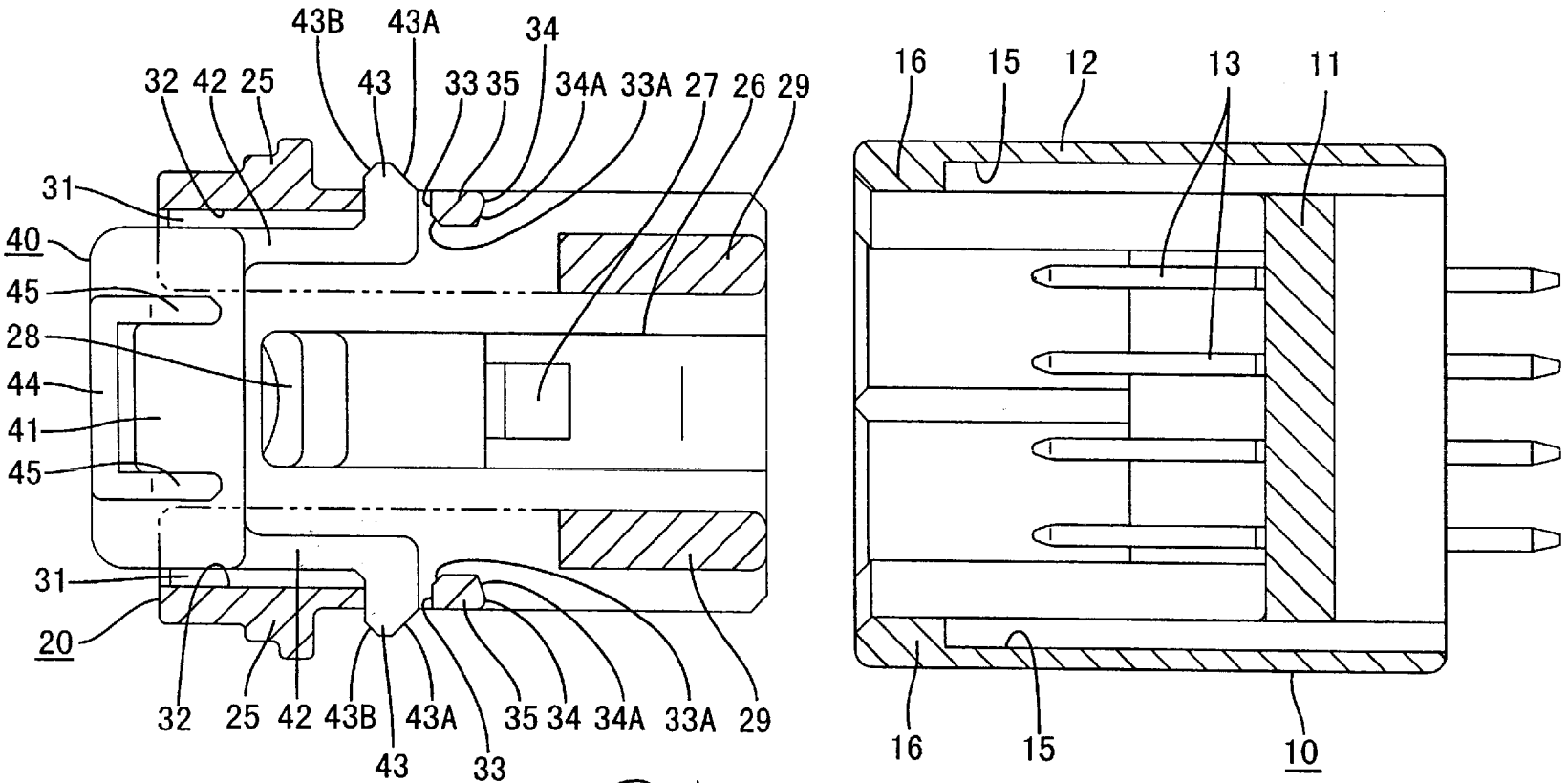
FIG. 1 is a disassembled plan cross-sectional view of a connector of an embodiment of the present invention.

As shown in FIG. 1, a connector of the present embodiment is formed from a male connector housing 10 that fits with a female connector housing 20. A fitting detecting member 40, for ascertaining the fitting state of the connector, is attached to the female housing 20. Fitting face sides of the two housings 10 and 20 will hereafter be considered as the anterior sides.

Figure 2:
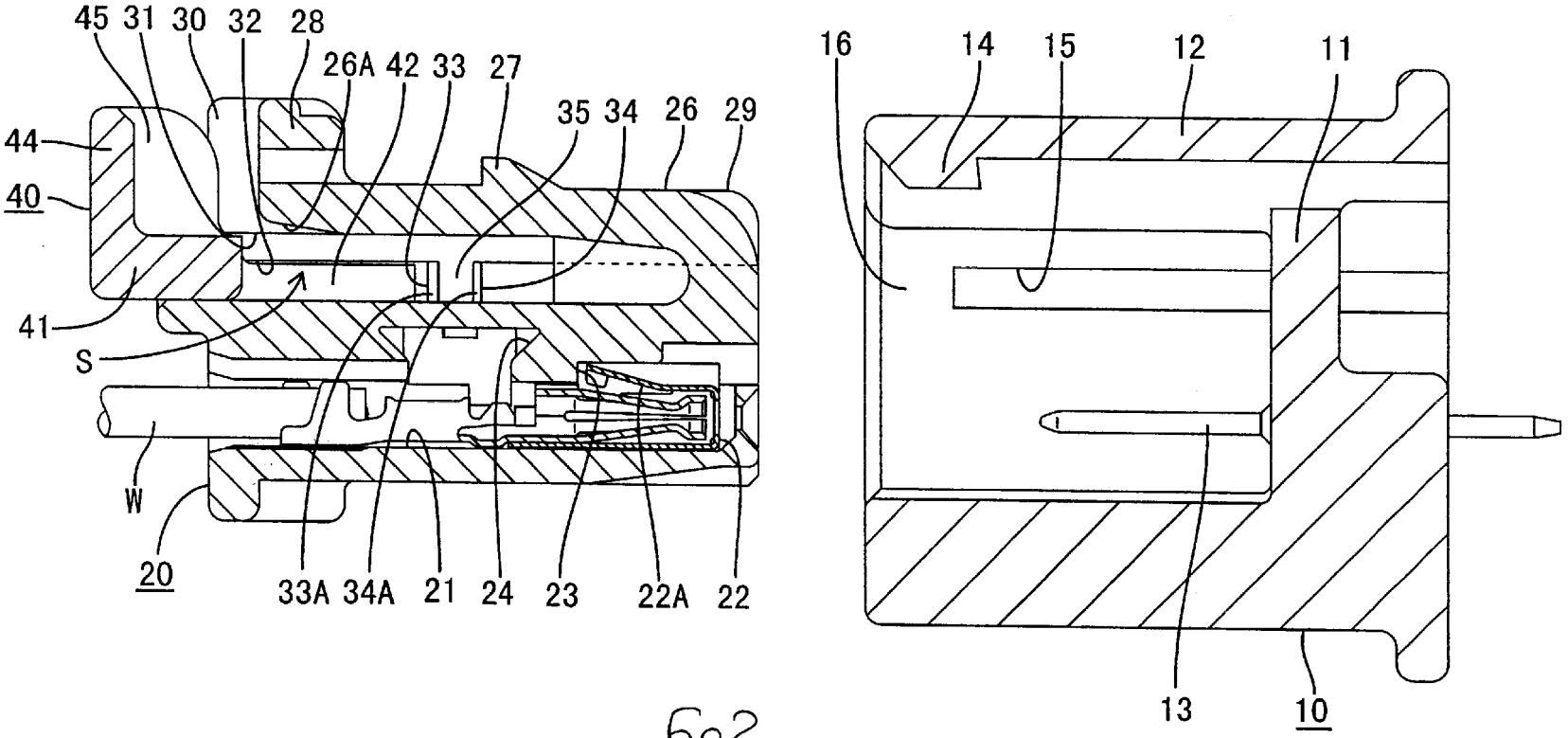
FIG. 2 is a disassembled side cross-sectional view of the connector.

As shown in FIGS. 1 and 2, the male housing 10 is provided with a wall member 11 and a cylindrical hood 12, this hood 12 protruding towards the anterior from the wall member 11. The female housing 20 can be fitted within the hood 12. Four tab-shaped male terminal fittings 13, these being aligned in a width-wise direction, pass through the wall member 11. As shown in FIG. 2, a hook-shaped locking member 14 protrudes downwards from an upper portion of the hood 12. A resilient locking arm 26 of the female housing 20 engages with this locking member 14.

Figure 3:
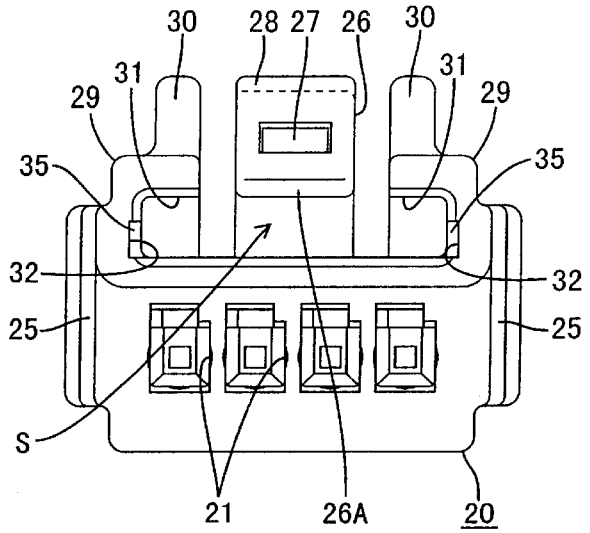
FIG. 3 is a rear face view of a female housing.

As shown in FIGS. 2 and 3, the female housing 20 has four cavities 21 aligned therein in positions corresponding to the male terminal fittings 13. As shown in FIG. 2, a female terminal fitting 22 can be housed within each cavity 21, each female terminal fitting 22 being crimped from the posterior to the end of an electric wire W. A step-shaped stopping member 23 is formed at an upper face of each cavity 21. Metal lances 22A formed by cutting into upper faces of the female terminal fittings engage with the stopping members 23. A retainer attachment hole 24 intersects with each cavity 21 of the female housing 20, a retainer (not shown) being attached through these retainer attachment holes 24 and retaining the female terminal fittings in an unremovable manner. A posterior end portion of the female housing 20 protrudes to the posterior relative to the upper portion (relative to the figures) of the cavities 21. A pair of step-shaped fitting operating members 25 protrude from left and right side faces (relative to FIG. 3) of the female housing 20, the female housing 20 being pushed into the male housing 10 by means of these fitting operating members 25.

As shown in FIGS. 1 and 2, the cantilevered locking arm 26 protrudes upwards from an upper face of the female housing 20, from a central location relative to the width-wide direction thereof. The locking arm 26 has its base end at the anterior end of the female housing 20 and an arm portion thereof extends towards the posterior from this base end. A posterior end of the locking arm 26 is located at a specified distance inwards from the posterior end of the upper face of the female housing 20. As shown in FIG. 2, the locking arm 26 is capable of bending, the arm portion thereof bending into a bending space S located below this arm portion. A posterior lower face of the arm portion grows thinner towards the posterior, forming a tapered face 26A. A locking protrusion 27 protrudes from the upper face of the locking arm 26 from a central location relative to the lengthwise direction thereof. When the two housings 10 and 20 are correctly fitted together, this locking protrusion 27 engages with the locking member 14 of the male housing 10. An anterior face of the locking protrusion 27 is a tapered face. A pushing operating member 28 protrudes from the posterior end of the upper face of the locking arm 26. Pushing this pushing operating member 28 from above causes the locking arm 26 to bend to a release position.

Figure 4:
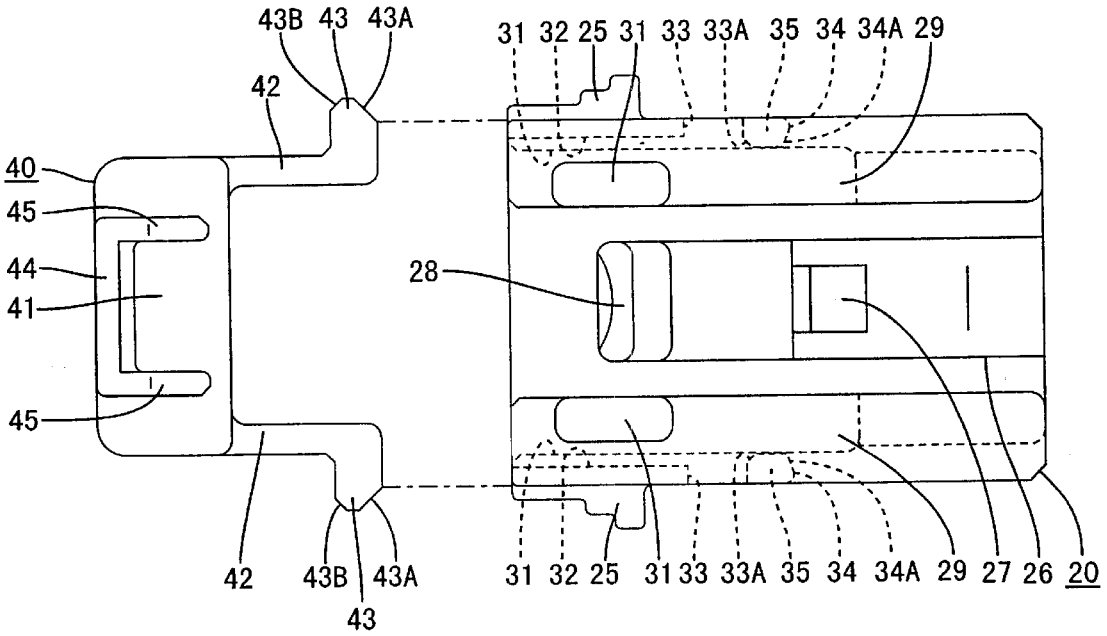
FIG. 4 is a plan view of the female housing and a detecting member.

As shown in FIGS. 3 and 4, a pair of side walls 29 are formed to the sides of the locking arm 26 on the upper face of the female housing 20. These side walls 29 protrude upwards and extend along the entire length of the female housing 20. Spaces having a specified width are maintained between inner faces of these side walls 29 and the locking arm 26. Outer faces of the side walls 29 form a unified face with outer side faces of the female housing 20. When the two housings 10 and 20 are being fitted together, inner side faces of the hood 12 of the male housing 10 slide against the outer faces of the side walls 29. A pair of protecting ribs 30 protrude upwards from upper faces of the side walls 29 at locations adjacent to the pushing operating member 28 of the locking arm 26. These protecting ribs 30 rise to the same height as the pushing operating member 28 and prevent the locking arm 26 from accidentally being bent.

As shown in FIG. 3, spaces are formed at the inner faces of the side walls 29, these spaces adjoining the bending space S of the locking arm 26 and forming attachment grooves 31. These attachment grooves 31 are open to the posterior of the female housing 20. Ceiling faces of the attachment grooves 31 have approximately the same height as the lower face of the locking arm 26. Lower faces of the attachment grooves 31 adjoin the upper face of the female housing 20. As shown in FIG. 1, anterior end faces of the attachment grooves 31 are located at approximately the same position as an anterior end of the locking protrusion 27 of the locking arm 26. The side walls 29 extend in to the anterior part of the attachment grooves 31.

Figure 10:
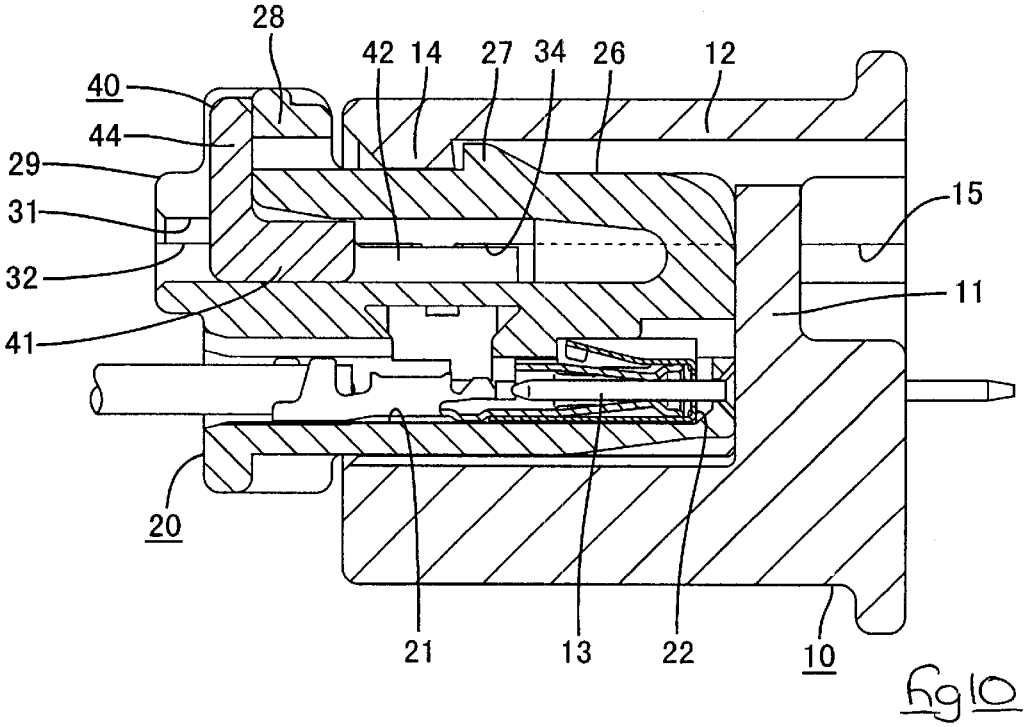
FIG. 10 is a side cross-sectional view showing the detecting member in a state whereby it has been moved to the operating position.

The detecting member 40 is attached from the posterior to the upper face of the female housing 20 via the attachment grooves 31. As shown in FIG. 1, the detecting member 40 is attached in a waiting position to the posterior of the locking arm 26 (that is, to the exterior of the bending space S). As shown in FIG. 10, after the two housings 10 and 20 have been fitted together, the detecting member 40 is inserted into the bending space S and is thus moved to an operating position, whereby it is capable of regulating the bending of the locking arm 26.

As shown in FIG. 4, the detecting member 40 is provided with a rectangular plate-shaped main body 41 and a pair of resilient stopping legs 42 that extend towards the anterior from both side edges of an anterior face of this main body 41. The main body 41 is slightly smaller than the heights of the bending space S of the locking arm 26 and the attachment grooves 31. The width of the main body 41 is approximately the same as the distance between both side faces of the two attachment grooves 31.

Figure 5:
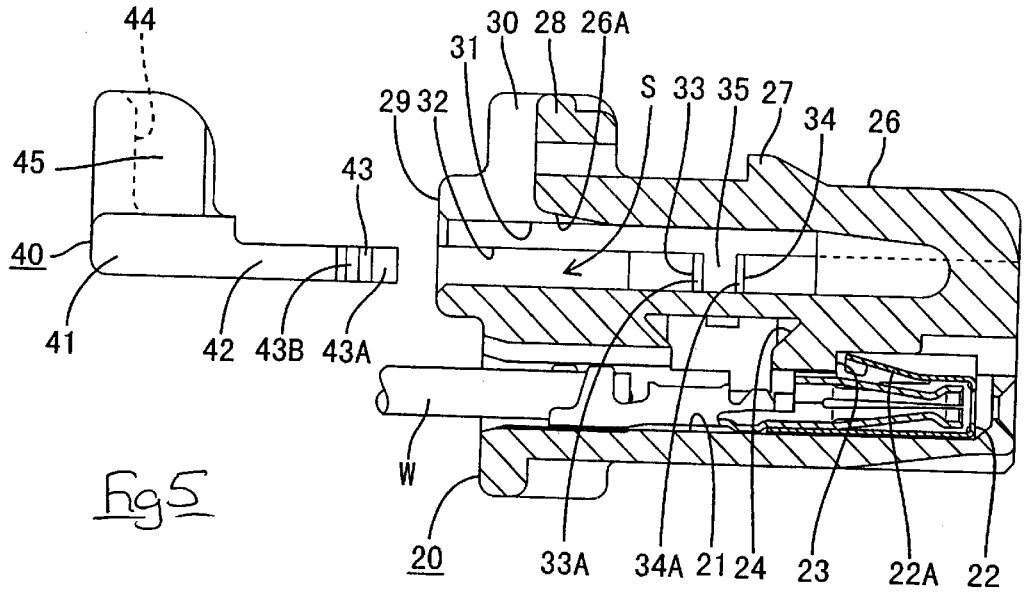
FIG. 5 is a partially cut-away side face view of the female housing and the detecting member.

Both resilient stopping legs 42 are capable of bending inwards resiliently. A hook-shaped protrusion extends outwards from an anterior end portion of each resilient stopping leg 42. The distance between protruding anterior ends of the resilient stopping arms 42 is approximately the same as the width of the upper face of the female housing 20. Retaining protrusions 43 extend outwards from the outwardly protruding anterior ends of the resilient stopping legs 42. Anterior and posterior faces of these retaining protrusions 43 form large tapered faces 43A and small tapered faces 43B respectively. Side faces of the resilient stopping legs 42 form unified faces with side faces of the main body 41. As shown in FIG. 5, lower faces of the resilient stopping legs 42 are level with lower faces of the main body 41, and the resilient stopping legs 42 are slightly shorter in height than the main body 41.

As shown in FIGS. 4 and 5, an operating member 44, for moving the detecting member 40, protrudes from a posterior end of the upper face of the mian body 41. This operating member 44 is plate-shaped and a posterior face thereof forms a unified face with a posterior face of the main body 41. A pair of protecting walls 45 protrude towards the anterior from both end portions of the operating member 44. Anterior ends of these protecting walls 45 are located somewhat towards the posterior relative to the anterior face of the main body 41. Anterior faces of the protecting walls 45 are arc shaped.

When the detecting member 40 is to be attached to the female housing 20, the resilient stopping legs 42 are first bent inwards, and the anterior ends thereof are inserted into the attachment grooves 31. As shown in FIGS. 3 and 5, a pair of guiding grooves 32, having the same dimensions as the resilient stopping legs 42, are formed in inner side faces of the attachment grooves 31. The resilient stopping legs 42 are fitted into these guiding grooves 32 and make sliding contact with inner faces thereof, thereby guiding the insertion of the resilient stopping legs 42. While the resilient stopping legs 42 are being inserted, both side ends of the main body 41 are inserted into the atachment grooves 31 and, as shown in FIG. 1, the detecting member 40 is attached in the waiting position with the main body 41 being located outside the bending space S of the locking arm 26. A pair of temporary stopping holes 33 are provided in anterior ends of the guiding grooves 32, these temporary stopping holes 33 being open to the side outer portions of the side walls 29. The retaining protrusions 43 of the resilient stopping legs 42 and the hook-shaped protrusions thereof can be inserted into the temporary stopping holes 33. The hook-shaped protrusions of the resilient stopping legs 42 engage with anterior and posterior hole edges of the temporary stopping holes 33, thereby maintaining the detecting member 40 in a state whereby it cannot move to the anterior or posterior from the waiting position. As shown in FIG. 5, the temporary stopping holes 33 have a quadrangular shape and are located at a height corresponding to the guiding grooves 32. As shown in FIG. 1, anterior portions of the hole edges of the temporary stopping holes 33 (the posterior face of pillar members 35) have inward-facing tapered faces 33A formed thereon.

When the detecting member 40 is in an attached state in the waiting position, the retaining protrusions 43 of the resilient stopping legs 42 protrude outwards from the outer face of the female housing 20. If the two housings 10 and 20 are fitted together from this state, an anterior end of the hood 12 of the male housing 10 makes contact with these retaining protrusions 43. Furthermore, the detecting member 40, in this waiting position, protrudes to the posterior for a specified distance from the posterior end of the female housing 20. When the detecting member 40 is in an attached state with the female housing 20, the two protecting walls 45 of the detecting member 40 are inserted in the spaces between the side walls 29 and the locking arm 26.

Figure 9:
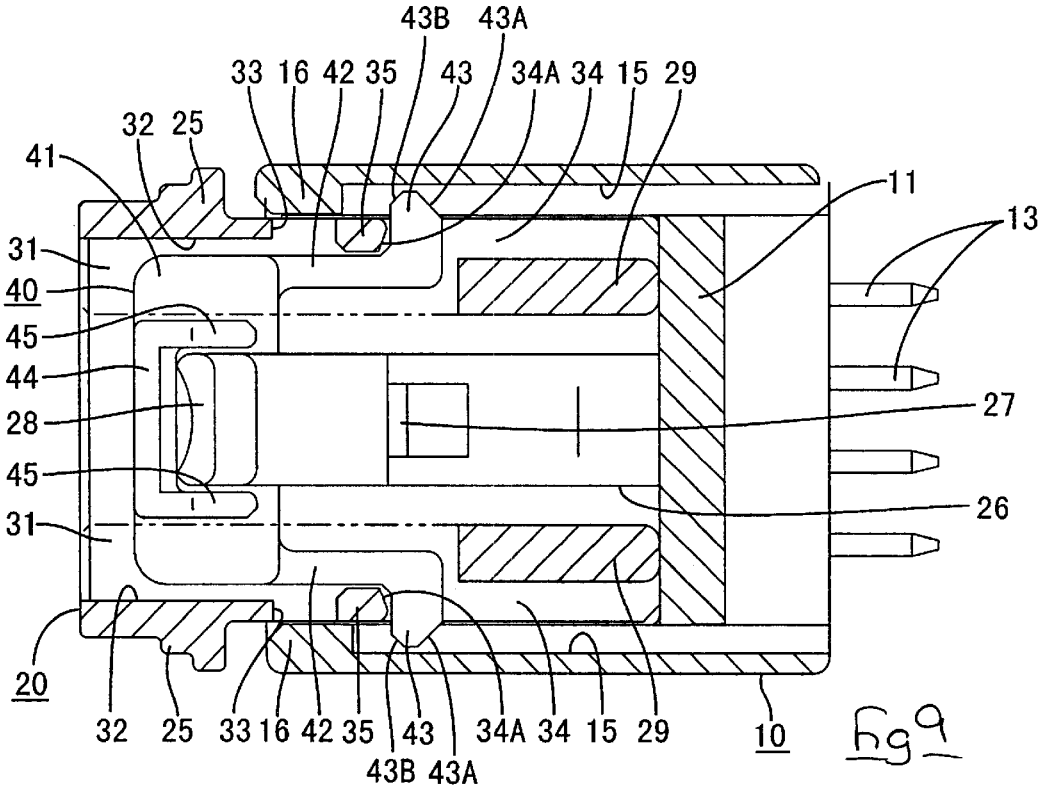
FIG. 9 is a plan cross-sectional view showing the detecting member in a state whereby it has been moved to an operating position.

As shown in FIG. 9, when the detecting member 40 is in the operating position, the resilient stopping legs 42 are inserted into main stopping holes 34 that are provided in the side walls 29 at a specified distance towards the anterior from the temporary stopping holes 33. The main stopping holes 34 are open to the anterior of the female housing 20, and the pillar members 35 remain between these main stopping holes 34 and the temporary stopping holes 33. At this juncture, the hook-shaped protrusions of the resilient stopping legs 42 engage with posterior hole edges (anterior faces of the pillar members 35) of the main stopping holes 34, thereby preventing the detecting member 40, which is in the operating position, from moving towards the posterior. The posterior hole edges of the main stopping holes 34 have inwardly-inclined tapered faces 34A formed thereon.

As shown in FIG. 10, at this juncture the portion surrounded by the operating member 44 and the protecting walls 45 of the main body 41 is inserted within the bending space S of the locking arm 26. The anterior end portion of the main body 41 is inserted to a position to the anterior of the tapered face 26A at the lower face of the locking arm 26. An anterior face of the operating member 44 makes contact with a posterior end face of the locking arm 26, thereby preventing the detecting member 40 from moving towards the anterior from the operating position. At the same time, the protecting walls 45 are located laterally relative to side faces of the locking arm 26.

As shown in FIGS. 1 and 2, a pair of grooves 15 are formed in the inner side faces of the hood 12 of the male housing 10. These grooves 15 are slit like, begin at a location at a specified distance towards the posterior from the anterior edge of the hood 12, and are open to the posterior of the male housing 10. The grooves 15 are located at a height corresponding to the main stopping holes 34 of the female housing 20 that has been fitted within the hood 12. The width of the grooves 15 is approximately the same as the height of the main stopping holes 34. As shown in FIG. 9, when two housings 10 and 20 have been correctly fitted together and the detecting member 40 is in the operating position, the retaining protrusions 43 of the resilient stopping legs 42 (these retaining protrusions 43 protruding outwards) pass from the outer face of the female housing 20 through the main stopping holes 34 and into the grooves 15. The grooves 15 are slightly deeper than the protruding length of the retaining protrusions 43. As a result, when the retaining protrusions 43 are fully housed, the resilient stopping legs 42 return resiliently to their free state. Thick members 16 at anterior sides of the grooves 15 are located so as to entirely cover the temporary stopping holes 33 when the two housings 10 and 20 are in the correct fitting state.

When the male housing 10 is to be moulded, molten plastic is injected into a mould (not shown). After the plastic has solidified, the mould is removed in the fitting direction of the two housings 10 and 20 (the anterior-posterior direction). The grooves 15 are slit like and open to the posterior of the male housing 10. Consequently, the mould that is removed to the posterior is provided with protruding portions for moulding the recessed grooves 15. As a result, insert moulds or other complicated configurations for moulding the recessed grooves 15 are not required.

Figure 6:
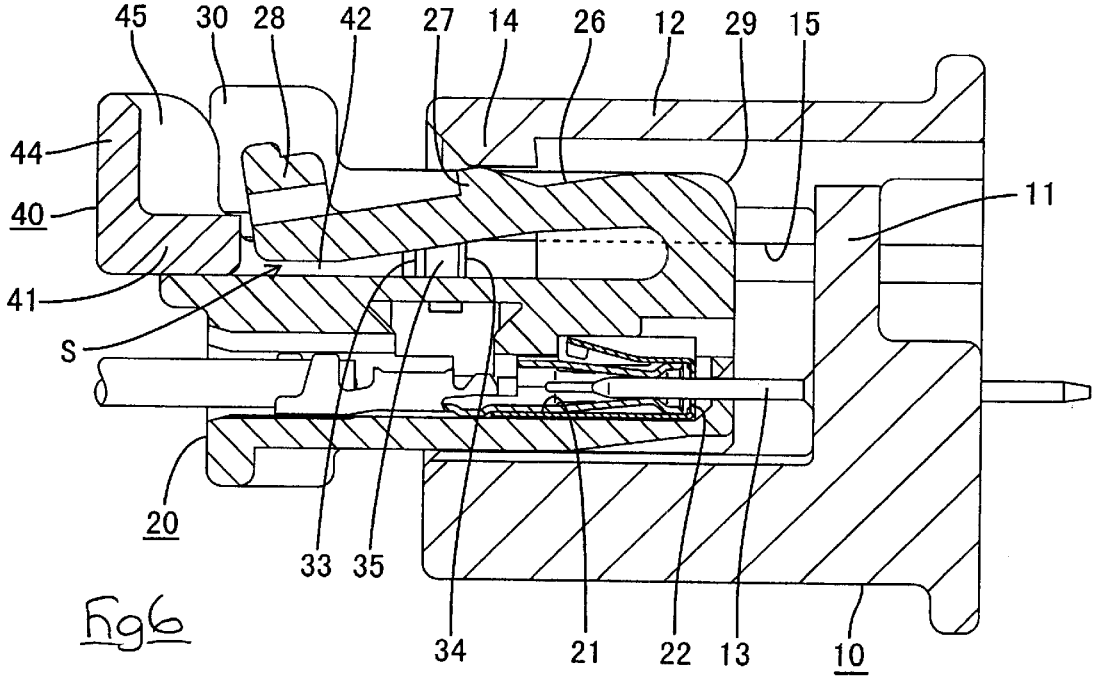
FIG. 6 is a side cross-sectional view showing two housings being fitted together.

The present embodiment is configured as described above. Next, the operation thereof will be described. After the detecting member 40 has been attached in the waiting position to the female housing 20, the two housings 10 and 20 are fitted together. When the female housing 20 is inserted into the hood 12 of the male housing 10, the inner side faces of the hood 12 make sliding contact with the outer faces of the side walls 29 of the female housing 20, and the locking protrusion 27 of the locking arm 26 makes contact with the locking member 14, the tapered faces thereof guiding one another and the locking arm 26 moving downwards into the bending space S (see FIG. 6).

While the detecting member 40 is in the waiting position, the resilient stopping arms 42 thereof engage with the hole edges of the temporary stopping holes 33, and the locking arm 26 is in the bending space S that is located to the anterior of the detecting member 40. Consequently, the detecting member 40 is doubly prevented from moving towards the anterior. The inability of the detecting member 40 to move in the anterior direction allows one to ascertain that the two housings 10 and 20 are partially fitted together.

When the fitting operation of the two housings 10 and 20 is to be completed, the anterior end of the hood 12 of the male housing 10 makes contact with the retaining protrusions 43 of the resilient stopping legs 42 protruding from the outer faces of the side walls 29 of the female housing 20. The tapered faces 43A at the anterior ends of the retaining protrusions 43 release the resilient stopping legs 42 from their retained state in the hole edges of the temporary stopping holes 33 while guiding these resilient stopping legs 42 inwards. When the outer faces of the retaining protrusions 43 have made contact with the inner face of the thick members 16 (see FIG. 7), the resilient stopping legs 42 are released from their retained state in the temporary stopping holes 33. Although the resilient stopping legs 42 no longer prevent the detecting member 40 from moving, the locking arm 26 remains inserted within the bending space S located to the anterior of the detecting member 40. Consequently, the anterior end of the main body 41 will make contact with the posterior end of the locking arm 26 if the detecting member 40 is pushed inwards from this state, thereby preventing the detecting member 40 from moving (see FIG. 6). By this means, it can be ascertained that the two housings 10 and 20 are partially fitted together.

Figure 8:
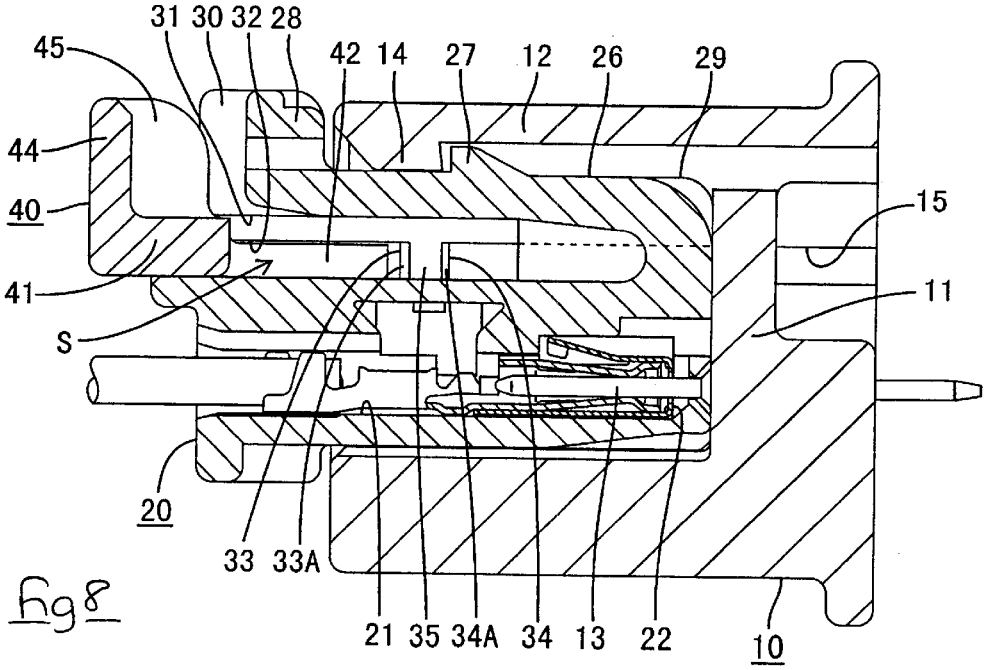
FIG. 8 is a side cross-sectional view of the two housings in a correctly fitted state.

As shown in FIG. 8, when the two housings 10 and 20 are correctly fitted together, the locking arm 26 returns to its original position and the locking protrusion 27 is retained by the locking member 14, thereby maintaining the two correctly fitted housings 10 and 20 in an inseparable state. The bending space S becomes vacant as the locking arm 26 returns to its original position, thereby allowing the detecting member 40 to move towards the anterior. At this juncture, the thick members 16 of the hood 12 of the male housing 10 are located along the sides of the temporary stopping holes 33, thereby covering them, and the recessed grooves 15 are located to the sides of the main stopping holes 34, the recessed grooves 15 and the main stopping holes 34 facing each other as a result.

Figure 7:
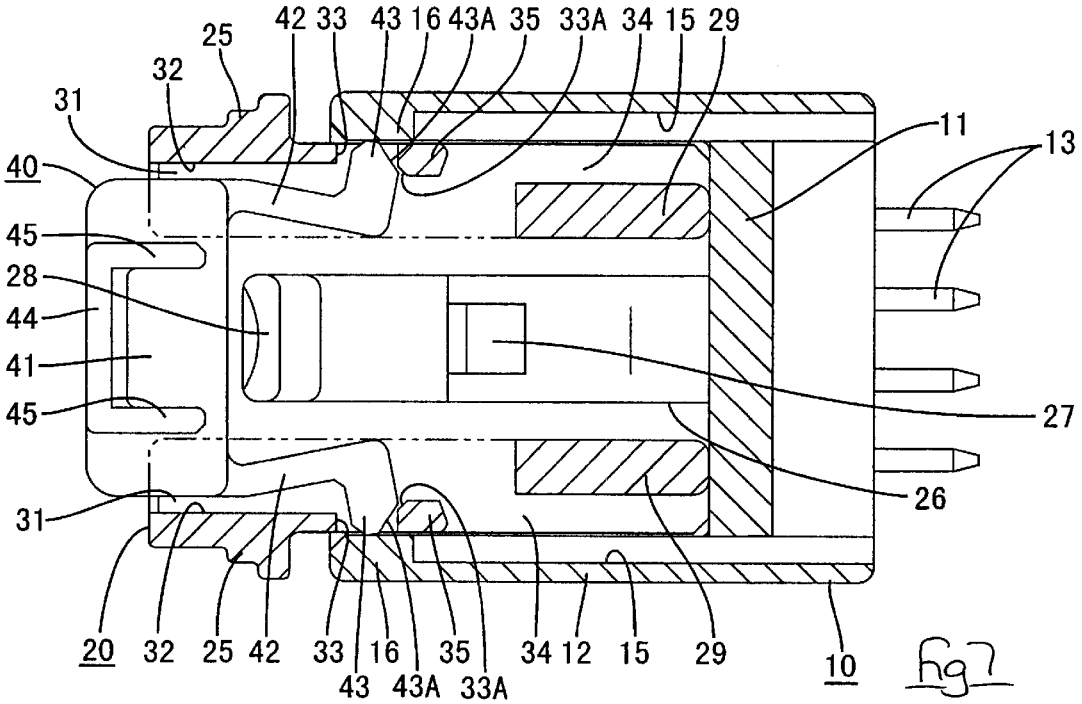
FIG. 7 is a plan cross-sectional view showing resilient stopping arms bent by a male housing.

When the operating member 44 of the detecting member 40 is pushed in, the detecting member 40 moves to the anterior, the main body 41 of the detecting member 40 entering the bending space S and the resilient stopping legs 42 bending inwards from the state shown in FIG. 7. The detecting member 40 reaches the operating position after the resilient stopping legs 42 have made contact with the inner faces of the pillar members 35 and the retaining protrusions 43 reach the main stopping holes 34. When the retaining protrusions 43 reach the main stopping holes 34, this causes the resilient stopping legs 42 to return from their bent state to their original position, causing the retaining protrusions 43 to leave the main stopping holes 34 and enter the recessed grooves 15 of the male housing 10 (see FIG. 9). At this juncture, the resilient stopping legs 42 have returned to their free state, and the hook-shaped protrusions of rhe resilient stopping legs 42 are engaged with the posterior hole edges of the main stopping holes 34, thereby preventing the detecting member 40, which is in the operating position, from moving towards the posterior.

As shown in FIG. 10, the main body 41 of the detecting member 40, which is in the operating position, is inserted into the bending space S of the locking arm 26, the anterior edge of the upper face of the main body 41 being adjacent to the lower face of the locking arm 26, thereby preventing the locking arm 26 from bending accidentally while the two housings 10 and 20 are in a fitted state. The anterior face of the operating member 44 makes contact with the posterior end face of the locking arm 26, thereby preventing the detecting member 40 from moving towards the anterior. Furthermore, as shown in FIG. 9, a portion of the posterior end of the locking arm 26 is surrounded by the operating member 44 and the proteting walls 45; these protect the posterior end of the locking arm 26 and the pushing operating member 28.

The operation of moving the detecting member 40 from the waiting position to the operating position is thus used, in the manner described above, the ascertain whether the two housings 10 and 20 have been correctly fitted together. Consequently, the connector can be used while the detecting member 40 is in the operating position. Since the resilient stopping legs 42 return resiliently to their original position and remain in the free state in the operating position, the resilient stopping legs 42 do not lose their resilience due to the creep phenomenon even if the connector is used for a long period.

If the two housing 10 and 20 are to be separated for maintenance or the like, a releasing jig is inserted from the posterior of the male housing 10 into the recessed grooves 15 and is used to bend the resilient stopping legs 42 inwards. The jig makes contact with the tapered faces 43A at the anterior ends of the retaining protrusions 43, thereby guiding the resilient stopping legs 42 inwards, bending them and releasing their retained state as the tapered faces 43B at the posterior side of the retaining protrusions 43 are guided against the tapered faces 34A of the hole edges at the posterior side of the main stopping holes 34. Then the operating member 44 is pulled, pulling the detecting member 40 from the operating position to the waiting position. After that, the locking arm 26 is bent, releasing the retained state of the two housings 10 and 20, and these two housings 10 and 20 are separated.

If the two housings 10 and 20 are to be fitted together again after having been separated for maintenance, the fitting operation described above is performed once more. Since the resilient stopping legs 42 remained in the free state while the connector was being used, the resilience thereof was not damaged, and the detecting member 40 can reliably be maintained in either the waiting position or the operating position.

According to the embodiment described above, the inner faces of the male housing 10 are provided with the recessed grooves 15 into which the retaining protrusions 43 of the resilient stopping legs 42 enter. As a result, when the two housings 10 and 20 have been correctly fitted together and the detecting member 40 is in the operating position, the resilient stopping legs 42 return to the free state, and consequently do not lose their resilience even if they remain in this state for a long period. In this manner, the resilience of the resilient stopping legs 42 can reliably be maintained even in the case where the two housings 10 and 20 are fitted together once again.

The grooves 15 are formed in a slit shape. Consquently, when the male housing 10 is moulded, it can be removed from the mould in an anterior-posterior direction. As a result, the mould does not require special configurations such as insert moulds for the grooves 15, and the configuration of the mould remains simple.

The present invention is not limited to the embodiments described above with the aid of figures. For example, the possibilities described below also lie within the technical range of the present invention. In addition, the prevent invention may be embodied in various other ways without deviating from the scope thereof.

(1) In the embodiment described above, the main stopping holes are open to the anterior of the female housing. However, they may equally well be open to the side of the female housing, like the temporary stopping holes. In that case, the resilient stopping arms engage with the anterior and posterior hole edges of the main stopping holes, the resilient stopping arms thereby preventing the detecting member, which is in the operating position, from moving to the anterior or the posterior.

(2) In the embodiment described above, the grooves are slit like. However, any other concave member into which the retaining protrusions of the resilient stopping arms can enter, such as cavities or through holes, may equally well be used.

What is claimed is:

1. A connector comprising a first housing having a hood and a second housing insertable within said hood in a fitting direction to a fully inserted condition, the second housing having a bendable latching arm extending in the fitting direction and engageable with a latch member of said first housing in the fully inserted condition, said connector defining a bending space for said latching arm and the connector further including a detecting member movable from a waiting position to an advanced condition in which said detecting member enters said bending space to prevent bending movement thereof, wherein said second housing has upstanding side walls extending in the fitting direction on either side of said latching arm and at a distance therefrom, said detecting member having two resilient legs extending respectively between said latching arm and a corresponding one of said side walls, each leg having an outwardly extending protrusion engageable through a corresponding aperture of the corresponding one of said side walls and for maintaining said detecting member in the waiting position, said hood being adapted to engage said protrusions on insertion of said second housing, and to force said protrusions inwards through the respective aperture to a releasing condition, and said side walls having respective openings to receive said protrusions in the advanced condition of said detecting member, thereby to retain said detecting member in said bending space, said first housing having recesses within said hood to accommodate said protrusions in the fully inserted condition of said second housing thereby permitting said legs to be unbent in the advanced condition of the detecting member, said openings being open in said fitting direction, said protrusions having a chamfer on a side facing said first housing, and said hood having an internally tapered mouth for contact with said protrusions.

2. A connector comprising a first housing having a hood and a second housing insertable within said hood in a fitting direction to a fully inserted condition, the second housing having a bendable latching arm extending in the fitting direction and engageable with a latch member of said first housing in the fully inserted condition, said connector defining a bending space for said latching arm and the connector further including a detecting member movable from a waiting position to an advanced condition in which said detecting member enters said bending space to prevent bending movement thereof, wherein said second housing has upstanding side walls extending in the fitting direction on either side of said latching arm and at a distance therefrom, said detecting member having two resilient legs extending respectively between said latching arm and a corresponding one of said side walls, each leg having an outwardly extending protrusion engageable through a corresponding aperture of the corresponding one of said sidewalls and for maintaining said detecting member in the waiting position, said hood being adapted to engage said protrusions on insertion of said second housing, and to force said protrusions inwards through the respective aperture to a releasing condition, and said side walls having respective openings to receive said protrusions in the advanced condition of said detecting member, thereby to retain said detecting member in said bending space, said first housing having recesses within said hood to accommodate said protrusions in the fully inserted condition of said second housing thereby permitting said legs to be unbent in the advanced condition of the detecting member.

3. A connector according to claim 1 wherein said openings are open in the fitting direction of said second housing.

4. A connector according to claim 1 wherein said side walls extend from a respective opening in a direction opposite to the fitting direction of said second housing and have a height equal to or greater than the free height of said latching arm.

5. A connector according to claim 1 wherein said detecting member has an upstanding member adapted for contact with said latching arm in the advanced condition.

6. A connector according to claim 1 wherein said recesses comprise channels in a wall of said hood, said channels being open to an exterior of said first housing in a direction opposite to the fitting direction thereof.

7. A connector according to claim 6 wherein said channels are closed to the exterior of said first housing in the fitting direction thereof.

8. A connector according to claim 1 wherein said protrusions have a chamfer on a side facing said first housing.

9. A connector according to claim 8 wherein said protrusions have a chamfer on a side facing away from said first housing.

10. A connector according to claim 1 wherein said hood has an internally tapered mouth for contact with said protrusions.

11. A connector according to claim 10 wherein the mouth of said hood fits closely against the outer side of said side walls in the fully inserted condition.

* * * * *